United States Patent [19]

Stubbings

[11] 4,354,410

[45] Oct. 19, 1982

[54] STRAIGHT LINE INSULATION CUTTER ASSEMBLY

[75] Inventor: James H. Stubbings, Rockville, Md.

[73] Assignee: Potomac Applied Mechanics, Inc., Bethesda, Md.

[21] Appl. No.: 858,066

[22] Filed: Dec. 6, 1977

[51] Int. Cl.[3] ..... B26D 1/18

[52] U.S. Cl. ..... 83/471.3; 83/486.1; 83/487; 83/614

[58] Field of Search ..... 83/486.1, 486, 487, 83/488, 12, 614, 522, 471–471.3

[56] References Cited

U.S. PATENT DOCUMENTS

| | | | |
|---|---|---|---|
| 2,101,317 | 12/1937 | Lemieux | 403/53 |
| 2,188,053 | 1/1940 | Madsen . | |
| 2,630,342 | 3/1953 | Gilmont | 403/53 |
| 2,706,653 | 4/1955 | Blakely | 403/53 |
| 3,008,498 | 11/1961 | Olson | 83/486 |
| 3,103,352 | 9/1963 | Steffen | 403/53 X |
| 3,207,016 | 9/1965 | Huff | 83/488 X |
| 3,460,226 | 8/1969 | Hildebrand . | |
| 3,830,128 | 8/1974 | Cochran et al. | 83/614 X |
| 3,866,496 | 2/1975 | Payne et al. | 83/486 X |
| 3,935,777 | 2/1976 | Bassett | 83/486.1 X |
| 3,967,519 | 7/1976 | Esterly | 83/486.1 X |
| 4,018,118 | 4/1977 | Goff | 83/488 X |

*Primary Examiner*—Frank T. Yost

*Attorney, Agent, or Firm*—Cushman, Darby & Cushman

[57] ABSTRACT

A sheet material cutting apparatus that is adjustable to cut pieces of insulation for duct work transition pieces or the like. First and second elongated support members are provided each having a cutting tool mounted thereon and movable along the length thereof. The support members are mounted at their opposite ends to first and second guide members, being pivotally movable with respect to the guide members and the support members being linearly movable with respect to the pivotal mounts. A cutting table is disposed beneath the cutting tools. The support members can be adjusted to any relative angular position with respect to each other, and with respect to the guide members, to cut out a wide variety of shapes of material from sheet material disposed on the support table. The guide members are also mounted so that the spacing therebetween is adjustable. Automatic or semi-automatic cutting of the sheet material may be effected using the cutting apparatus.

3 Claims, 4 Drawing Figures

STRAIGHT LINE INSULATION CUTTER ASSEMBLY

BACKGROUND AND SUMMARY OF THE INVENTION

The invention relates to apparatus for cutting sheet material into any of a wide variety of polygon shapes. The invention is particularly useful for cutting pieces of insulation for use to line duct work transition pieces. The cutting apparatus of the invention can be designed to be semi-automatic or fully automatic. Semi-automatic operation is desirable, and according to the invention, a single operator may quickly and easily cut out a wide variety of shapes of sheet material with minimum effort.

According to the present invention, the sheet material cutting apparatus includes a first elongated support member with a first cutting tool mounted on the first support member for movement therealong. A sheet material support surface is provided with first and second guide members disposed on opposite sides of the support surface. Means are provided for pivotally mounting the first support member, for pivotal movement about a generally vertical axis, with respect to each of the first and second guide members, means are provided for providing linear movement of the pivotal mounting means with respect to the first and second guide members, along the first and second guide members, and means are provided for providing linear relative movement between the support member and the pivotal mounting means. The first and second guide members are spaced a predetermined distance apart and disposed in the same generally horizontal plane. Means are provided for moving the cutting tool along the first support member so that cutting of sheet material, disposed on the support surface, along the line parallel to the first support member is effected.

Additionally, it is preferred that a second elongated support member be provided with a second cutting tool mounted thereon, the second support member being linearly movable with respect to the first and second guide members along the first and second guide members, and the cutting tool being movable along the second support member so that cutting of sheet material, disposed on the support surface, along the line parallel to the second support member is effected. The guide members also are preferably mounted so that they are movable with respect to each other, always being disposed in a parallel relationship. Such a movement can be effected by providing a pair of lead screws, traveling nuts associated with one of the guide members and each lead screw, and a hand crank arrangement or the like for rotating both of the lead screws at the same time.

Power means may be provided for moving the cutting tool along the support members, such as an electric motor and a pinion driven by the motor, which pinion engages a rack on the support member. Alternatively, a simple handle may be provided on the cutter tool and the handle grasped to move the tool, or a rope or the like attached to the handle to pull it along a desired path. The cutting tool preferably will comprise a cutting wheel, and the wheel may either effect cutting as it is moved along the insulation, or the wheel can be powered. In the normal situation, the wheel would effect cutting just as it is moved along the material to be cut, and in this way could be a wheel such as shown in U.S. Pat. No. 4,050,336.

In adjusting the support members with respect to the guide members, locking screws or the like are released to allow linear movement of the support members with respect to the pivotal mounting means, and the pivotal mounting means with respect to the guide members, so that any angular orientation may be provided between the support members and between the support members and the guide members.

If desired, the cutting wheels could be mounted so that they may also assume a 90° orientation with respect to the support members, and in this case would be mounted generally as shown in FIG. 3*b* of U.S. Pat. No. 4,050,336.

It is the primary object of the present invention to provide semi-automatic cutting apparatus for quickly and easily cutting a wide variety of polygon shapes from sheet material, especially cutting insulation for lining transition duct work pieces. This and other objects of the invention will become clear from an inspection and the detailed description of the invention, and from the appended claims.

DETAILED DESCRIPTION OF THE DRAWINGS

Figure 1:
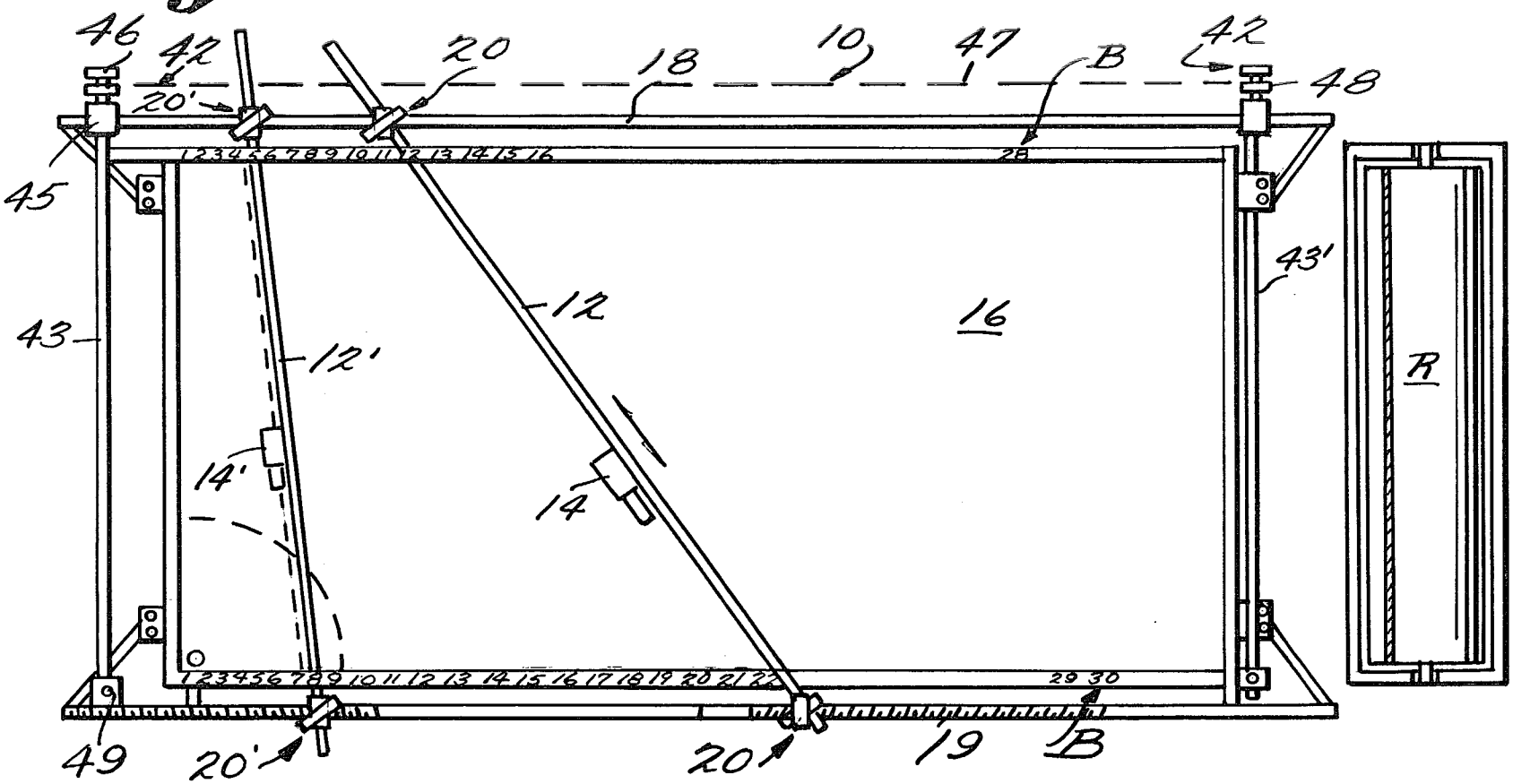
FIG. 1 is a top plan view of exemplary apparatus according to the invention.

Exemplary sheet material cutting apparatus according to the present invention is shown generally at 10 in FIG. 1. The term "cutting" as used in the present specification and claims does not necessarily imply that a cutting tool must make a complete cut through the sheet material, but rather the cut need only be through a portion of the sheet material, final separation being effected by other means where desirable.

The apparatus 10 as shown in the drawings includes the following elements: A first elongated support member 12. A first cutting tool 14 for cutting sheet material. A sheet material support surface 16. First and second guide members 18, 19, the support surface 16 being disposed generally horizontally inbetween the guide members, and the guide members spaced a predetermined distance apart and disposed in a same generally horizontal plane (the guide members 18, 19 preferably being slightly vertically above the sheet material support surface 16). Means 20 for pivotally mounting the first support member 12, for pivotal movement about a generally vertical axis, with respect to each of the first and second guide members 18, 19. Means 21 for providing linear relative movement between the first support member 12 and the pivotal mounting means 20 (see FIG. 3). Means 25 for providing linear movement of the pivotal mounting means 20 with respect to the first and second guide member 18, 19 along the first and second guide members (see FIG. 3). Means 29 for mounting the first cutting tool 14 on the first support member 12 for movement therealong, and means 30 for moving the cutting tool along the first support member 12, so that cutting of sheet material, disposed on the support surface 16, along the line parallel to the member 12 is effected.

Figure 3:
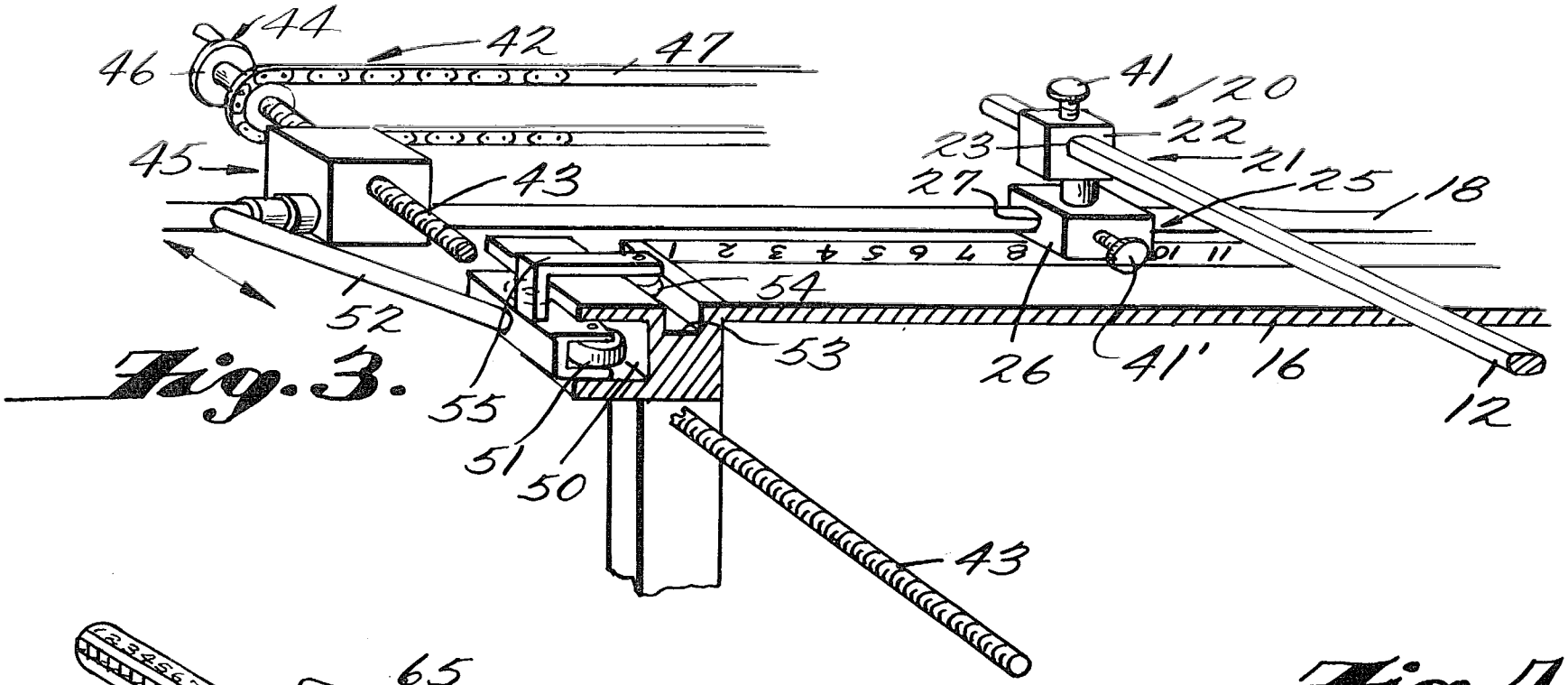
FIG. 3 is a perspective detailed view illustrating the interconnection between exemplary guide members, support members, and the support table according to the invention.
Figure 4:
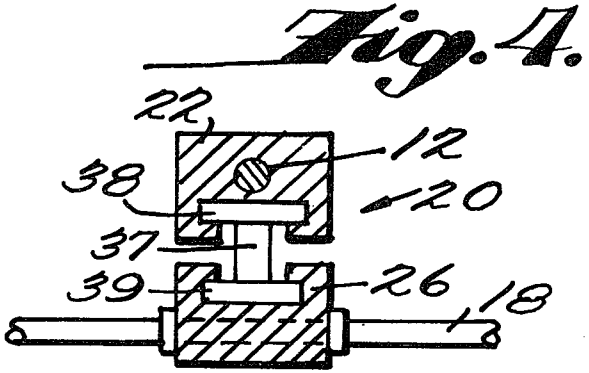
FIG. 4 is a cross-sectional view of exemplary means for pivotally mounting a support member with respect to a guide member.

As shown most clearly in FIG. 3, the means 21 includes a block 22 having an opening 23 defined therein, the opening being substantially the same shape as the member 12, but being slightly larger than the member 12 so that sliding movement between member 12 and block 22 can take place. The means 25 similarly includes a block 26 with an opening 27 therein which opening 27 receives a guide member (18, 19) therein, being slightly larger than the guide member to allow sliding movement between the guide member and the block 26. The blocks 22 and 26 also comprise component parts of the means 20 for pivotally mounting the support member 12 with respect to the guide members 18, 19. A means 20 is associated with each guide member 18, 19 at opposite portions of the support member 12. The means 20 further comprises—as shown in FIG. 4—a shaft 37 or the like cooperating with roller bearing assemblies 38, 39 set in channels in the blocks 22, 26, the roller bearing assemblies allowing low friction rotation of the block 22—connected to support member 12—with respect to the block 26—connected to guide member 18.

Figure 2:
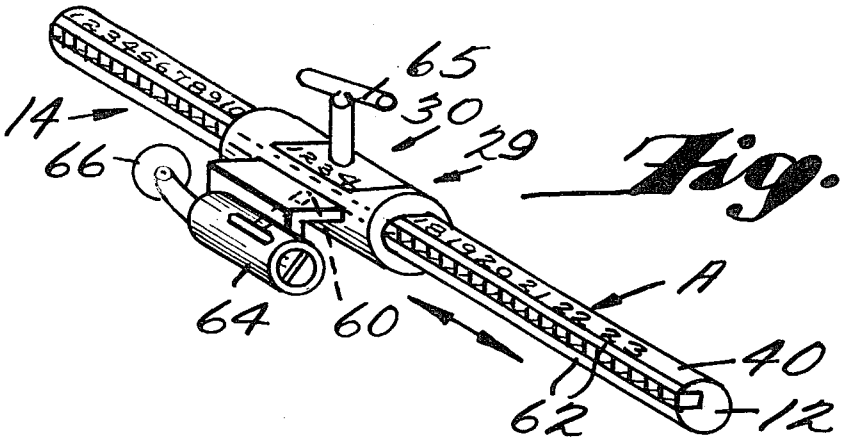
FIG. 2 is a perspective schematic view showing the relationship between a cutting tool and support member that may be used according to the invention.

As shown in FIG. 2, it is desirable for the support member 12 to have a flattened upper surface 40, at least one of the blocks 22 having a correspondingly shaped opening, and the portion 40 having indicia A formed therealong.

In addition, locking means 41 are provided associated with at least one of the blocks 22, and locking means 41' are provided associated with the blocks 26. The locking means 41, 41', which may merely comprise screws threaded through openings in the blocks 22, 26 for engaging surface portions of the members 12, 18 respectively, provide means for preventing linear relative movement between the support member 12 and mounting means 20, and guide members 18, 19 and mounting means 20, respectively. The locking means 41, 41' will be loosened until the members 12, 18–19, 20 are in proper orientation, and then the locking means 41, 41' are retightened.

The apparatus according to the present invention is most effective when a second elongated support member 12' is provided, corresponding generally to the first support member 12 and having similar component parts associated therewith, including a second cutting tool 14', second pivotally mounting means 20', etc.

Under some circumstances, it is desirable, especially where different widths of sheet material are to be cut, to provide means 42 for moving the first guide member 18 with respect to the second guide member 19. The guide members 18, 19 are supported slightly above the surface of the sheet material support surface 16 and are disposed parallel to each other, the moving means 42 moving the members 18, 19 relative to each other so that they stay parallel to each other. The moving means 42, as best shown in FIGS. 1 and 3, preferably comprises a pair of lead screws 43 extending between the members 18, 19, means 44 for rotating the lead screws in tandem, and means 45 associated with each lead screw and one of the guide members (18) for transforming rotation of the lead screws 23 into linear movement of that guide member (18) with respect to the other guide member (19). The means 45 may comprise a conventional traveling nut, one associated with each lead screw and receiving a guide member (see FIG. 3), and the moving means 42 further comprises a pair of parallel guiding edge surface manifestations 50 (shown as channels in FIG. 3) of the support surface 16 disposed parallel to the lead screws 43, and guide roller means 51 associated with each nut 45 for engaging the surface manifestations 50, and means—such as a brace 52—connecting each nut 45 to the guide roller means 51 for effecting guided movement of the nuts 45 with respect to the support surface 16. A second set of surface manifestations 53 with cooperating roller assemblies 54, connected to brace 52 by flange 55, also may be provided. The means 44 for rotating the lead screws in tandem may comprise a hand crank 46 connected to one of the lead screws 43, and connected by a chain 47 to a sprocket 48 associated with the other lead screw 43. The ends of the lead screws 43 opposite the traveling nuts 45 may be associated with bushings 49.

While the guide members 18, 19 will be generally supported with respect to the support surface 16 by the means 50, 51 etc., where desirable wheeled support stands or other supports may be provided at intermediate positions thereof.

The mounting means 29, as shown in FIG. 2, preferably includes a collar surrounding the member 12, and where the cutting tool is to be moved along the member 12 by power means, a pinion 60 and rack 62 are provided. The power means takes the form of an electric motor 64, and is operatively connected to the pinion 60 to drive the collar 29 along the member 12. The power means 64 may comprise the moving means 30, although the moving means 30 also may be manual, such as a handle 65 which may be grasped by an operator and pulled along the support 12 (in which case the rack and pinion arrangement 62, 60 is not necessary as long as the member 12 is keyed to the collar 29), or a rope or the like may be attached to the handle member to facilitate pulling it along the support member 12, especially where the supporting surface 16 is wide. A cutting wheel 66 preferably is associated with the cutting tool 14, and rotates as it is moved along the support member 12, in contact with the work to be cut. The cutting wheel 66 may also be powered if desired, and/or may be spring pressed into engagement with the sheet material to be cut on the surface 16, and may be mounted so the orientation of the horizontal axis about which it rotates may be changed (such as shown in FIG. 3*b* in U.S. Pat. No. 4,050,336).

OPERATION

Apparatus according to the present invention having been described, an exemplary mode of operation thereof will now be set forth. Insulation, or like sheet material, is moved onto the support surface 16, as by unrolling it from a roll R (see FIG. 1). The cutting tool 14 is originally positioned so it is out of interfering engagement with the sheet material on the surface 16 until the sheet material is in place and the support members 12, 12' have been adjusted to effect cutting of a desired pattern from the sheet material.

Although only one support member 12 and associated cutting tool 14 may be provided, two different cuts being made therewith for each piece of material to be cut from the sheet material, the operation will be described with reference to two different support members 12, 12' being provided.

The locking means 41 associated with the blocks 22 of the means 20, 20' associated with guide member 18, and the locking means 41' associated with the blocks 26, which blocks are associated with both the guide members 18, 19, are loosened to allow relative movement between the component parts. The means 20 are then moved along the guide members 18, 19, resulting in consequent movement of the members 12, 12' to adjust for the effective length between the members 20 associated with the guide member 18, 19 for each member 12, 12', until the desired position is achieved, using the indicia B disposed along the parallel side edges of the material supporting surface 16. Once the component parts have been moved into the desired orientation so that a piece of sheet material of desired shape may be cut (shown in dotted line in FIG. 1), the locking means 41, 41' are again tightened. Then, the cutting tools 14, 14' are moved along the members 12, 12', by the moving means 30, straight lines being cut in the sheet material parallel to the members 12, 12'. The cut piece is then moved off of the surface 16, and a new portion of the sheet material 16 is moved into place beneath the members 12, 12'.

Normally, one width of sheet material will be cut with the apparatus 10, however, where narrower widths than the maximum width are desirably cut, the hand crank 46 is turned (with the locking means 41 loosened) and the guide member 18 moves toward the guide member 19 to the desired small width, at which point the necessary adjustments of the members 12, 12' are made and cutting effected. Since the invention is primarily designed for cutting pieces of insulation for use with transition pieces of sheet metal duct work (which duct work may be formed as shown in copending application Ser. No. 648,776, filed Jan. 13, 1976), normally no cuts will be made in the sheet material along the length thereof (i.e. parallel to the members 18, 19), but rather the normal edges of the sheet material will be utilized. However, in situations where cutting along these portions also is desirable, the sheet material may either be reorientated after the original cuts to again place it under the members 12, 12', with the necessary adjustments made in the members 12, 12', or the cutting wheels 66 may be provided so that they may be moved perpendicular to the position illustrated in the drawings, with the cutting tools 14 then being pulled so that the members 12, 12' slide along the members 18, 19 to effect cutting.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Sheet material cutting apparatus comprising:

a first elongated support member;

a first cutting tool for cutting sheet material;

a sheet material support surface;

first and second guide members disposed generally parallel to each other, said support surface being disposed generally horizontally in between said guide members, and said guide members spaced a predetermined distance apart and disposed in a same, generally horizontal, plane;

means for pivotally mounting said first support member, for pivotal movement about a generally vertical axis, with respect to each of said first and second guide members;

means for providing linear movement of said pivotally mounting means with respect to said first and second guide members, along said first and second guide members;

means for providing linear relative movement between said first support member and said pivotally mounting means;

means for mounting said first cutting tool on said first support member for movement along said first support member, and means for moving said cutting tool along first support member, so that cutting of sheet material, disposed on said support surface, along a line parallel to said first support member is effected;

and means for moving said first guide member with respect to said second guide member so that they stay parallel to each other, said moving means comprising: a pair of lead screws extending between said first and second guide members; means for rotating said lead screws in tandem; and means associated with each lead screw and one of said guide members for transforming rotation of said lead screws into linear movement of said guide members relative to each other, said transforming means comprising a traveling nut associated with each lead screw and one of said guide members; and wherein said moving means further comprises a pair of parallel guiding edge surface manifestations of said said support surface disposed parallel to said lead screws, guide roller means associated with each nut for engaging said guiding edge surface manifestations, and means operatively connecting each nut to said guide roller means for effecting guided movement of said nuts with respect to said support surface.

2. Sheet material cutting apparatus comprising:

a first elongated support member;

a first cutting tool for cutting sheet material;

a sheet material support surface;

first and second guide members, said support surface being disposed generally horizontally in between said guide members, and said guide members spaced a predetermined distance apart and disposed in a same, generally horizontal, plane;

means for pivotally mounting said first support member, for pivotal movement about a generally vertical axis, with respect to each of said first and second guide members; wherein said first support pivotally mounting means comprises: first and second blocks associated with each guide member, each said first block having means defining an opening therein for receiving said first support member, and each said second block having means defining an opening therein for receiving said associated guide member therein; first and second roller bearing assemblies associated with each said first and second blocks, respectively; and a shaft extending between and operatively associated with each of said first and second bearings;

means for providing linear movement of said pivotally mounting means with respect to said first and second guide members, along said first and second guide members;

means for providing linear relative movement between said first support member and said pivotally mounting means;

means for mounting said first cutting tool on said first support member for movement along said first support member, and means for moving said cutting tool along first support member, so that cutting of sheet material, disposed on said support surface, along a line parallel to said first support member is effect;

means for moving said first guide member with respect to said second guide member.

3. Apparatus as recited in claim 2 further comprising a thumb screw associated with each block extending into the opening defined therein.

* * * * *